US005622198A

United States Patent [19]

Elsinger

[11] Patent Number: 5,622,198

[45] Date of Patent: Apr. 22, 1997

[54] PORTABLE COLLAPSIBLE SHELTER

[76] Inventor: Raymond A. Elsinger, 4987 Highway WS., P.O. Box 51, Woodland, Wis. 53099

[21] Appl. No.: 583,423

[22] Filed: Jan. 5, 1996

[51] Int. Cl.[6] ..... E04B 1/343

[52] U.S. Cl. ..... 135/128; 135/95; 135/900; 135/901; 135/905; 135/96; 135/97; 135/137; 135/140; 135/148; 135/149; 135/116

[58] Field of Search ..... 135/95, 96, 97, 135/128, 137, 140, 143, 148, 149, 157, 115, 116, 900, 901, 903, 905; 52/63

[56] References Cited

U.S. PATENT DOCUMENTS

| | | | |
|---|---|---|---|
| 2,311,515 | 2/1943 | Bridge | 135/901 X |
| 2,473,076 | 6/1949 | Scheibner | 135/901 X |
| 2,717,160 | 9/1955 | Schmidt et al. | 135/116 X |
| 3,744,500 | 7/1973 | Briggs | 135/96 X |
| 3,820,805 | 6/1974 | Tuomala | 135/901 X |
| 3,826,270 | 7/1974 | Hentges | 135/149 X |
| 5,033,493 | 7/1991 | Senchuck | 135/901 X |
| 5,133,378 | 7/1992 | Tanasychuk | 135/901 X |
| 5,341,588 | 8/1994 | Lizotte | 135/901 X |
| 5,368,057 | 11/1994 | Lubkeman et al. | 135/901 X |
| 5,458,079 | 10/1995 | Matthews et al. | 135/901 X |

*Primary Examiner*—Wynn E. Wood

[57] ABSTRACT

A portable collapsible shelter comprises a floor, pairs of corner posts, a horizontal brace extending between and pivotally attached to the corner posts of each pair, and built-in seats. The floor, corner posts, braces, and seats are foldable between respective erected and collapsed modes. In the collapsed mode, each corner post is folded into a stack, with the stacks of each pair thereof being coplanar. The associated brace is initially at the top of the stacks of folded corner posts. The brace folds into a stack located coplanar with and between the stacks of the associated corner posts when the floor is folded to its collapsed mode. The seats fold with the corner posts and lie on the floor when the corner posts are folded to their collapsed mode. Locking devices selectively prevent and enable folding of the floor, corner posts, and braces.

18 Claims, 7 Drawing Sheets

PORTABLE COLLAPSIBLE SHELTER

BACKGROUND OF THE INVENTION

1. Field of the Invention

This invention pertains to temporary shelters, and more particularly to collapsible shelters that are transportable to and erectable at desired sites.

2. Description of the Prior Art

Various types of equipment have been developed to provide temporary shelter to persons working or playing out of doors. For example, ice fishing shanties are well known.

Some ice fishing shanties are more or less permanent structures. That is, once built, they remain essentially completed and ready to use. They are portable in the sense of being transportable from a summer storage site to an ice fishing site, but they do not undergo substantial assembly or disassembly prior to or after transportation.

Other ice fishing shanties are collapsible. Such shanties are normally stored and transported in a collapsed state. Upon reaching the desired fishing site, they are erected to provide shelter to one or more fishermen. When it is desired to again move the shanties, they are first collapsed.

Ice fishing shanties of the permanent type have an important advantage over the collapsible type. That advantage is that a fisherman need not spend any time erecting his shelter after he has transported it to the desired fishing location. A corollary benefit is that he does not have to collapse the shelter at the end of the fishing season. On the other hand, permanent type shanties suffer the handicap of being much more difficult to transport than collapsible shanties. A large truck or even a trailer is normally required to transport a permanent type shanty. In contrast, a relatively small truck or even an automobile is usually sufficient to transport a collapsed shanty.

A further disadvantage of permanent type shanties is that they are almost always stored outdoors during the summer. Consequently, they are continuously exposed to the elements. Exterior repairs can be made only when the weather is suitable. Further, permanent type shanties are not always very attractive, so their owners must find out-of-the-way storage locations. Conversely, the small volume occupied by collapsed shanties enable them to be stored in garages or barns, where they can be repaired at the owner's leisure.

Because of the ease with which collapsible ice fishing shanties are transported, they have been popular over the years. Examples of older style collapsible style shanties are shown in U.S. Pat. Nos. 3,971,395; 3,874,398; 3,854,746; 3,820,805; 3,492,015; 3,173,436; 3,157,185; and reissue 26,140. More recently developed portable shanties may be seen in U.S. Pat. Nos. 5,133,378; 4,938,243; 4,926,893; 4,917,127; 4,526,391; and 4,438,940.

Despite the large number of different collapsible ice fishing shanties available, most are quite small when erected, being suitable for one or at the most two persons. Since ice fishing is often undertaken by groups of more than two persons, there is a need for a larger collapsible shanty.

SUMMARY OF THE INVENTION

In accordance with the present invention, a portable collapsible shelter is provided that can comfortably hold four persons when erected but that occupies only a small volume when collapsed. This is accomplished by apparatus that includes a floor and a frame that are selectively erectable to support a removable protective cover and collapsible to occupy a minimum of space.

The floor of the portable collapsible shelter is made in three sections, with two side sections being rotatably joined along parallel respective folding axes to opposite sides of a middle section. When the portable collapsible shelter is erected, the three floor sections are horizontal and coplanar. Locking rods keep the floor side sections from unintentionally rotating relative to the middle section. When the portable collapsible shelter is collapsed, the two floor side sections are vertically upright. When the portable collapsible shelter is erected, the three floor sections are supported off the ground by respective feet that include long skis. When the portable collapsible shelter is collapsed and the floor side sections are upright, the entire shelter is supported by the skis under the floor middle section.

The frame is comprised of at least two pairs of collapsible posts. The pairs of posts lie in respective planes that are perpendicular to the floor folding axes. Each post is made up of two or more tubes and hinges that interconnect the ends of respective adjacent tubes. The lowermost tubes of two posts are hinged at their respective lower ends to one of the floor side sections. The lowermost tubes of the other two posts are hinged at their respective lower ends to the other floor side section. Subsequent higher tubes of each post are hinged at their respective lower ends to the upper ends of the adjacent lower tubes. The hinges are so located that when a post is erected, its tubes are all colinear. When the post is collapsed, its tubes are folded along side each other in a vertical stack. The planes of the stacks of all collapsed posts are perpendicular to the floor folding axes. The stacks of one pair of collapsed posts lie in a first plane, and the stacks of the other pair of collapsed posts lie in a second plane.

There is a slide lock associated with each hinge of the posts. When a slide lock is retracted, it lies entirely within one of the two tubes connected by an associated hinge. In that situation, the two adjacent tubes are free to pivot relative to each other by means of the hinge. When two adjacent tubes are pivoted such that they are colinear, the associated slide lock can be extended into the adjacent tube to lock the two tubes to each other and prevent pivoting. A similar slide lock is employed between the lower end of the lowermost tube of each post and the corresponding floor side section.

A collapsible brace extends between the posts of each pair thereof. Each brace is pivotally connected at its opposite ends to the upper ends of the uppermost tubes of the posts of a pair of posts. Each brace is composed of two or more tubes that are pivotally connected to each other. Each brace is designed to collapse such that the tubes thereof fold along side each other accordion style. When collapsed, each brace lies in the same plane as the stacks of the associated pair of collapsed posts. Slide locks associated with the brace hinges selectively prevent or allow pivoting of the brace tubes relative to each other.

The frame further comprises rigid bars extending parallel to the folding axes of the floor sections. There is a bar extending generally between the corresponding posts of the pairs thereof. Those bars are rigidly fastened to the brace tubes that are hingedly connected to the associated post uppermost tubes. Additional bars may extend between and be fastened to other corresponding brace tubes. The bars assure that the braces fastened to the bars move together.

The collapsible portable shelter further comprises seats that collapse neatly and compactly with the posts. The seats extend parallel to the floor folding axes. The seats are swivelably supported at their opposite ends to corresponding posts of different pairs thereof. One or more seat columns are pivotally connected to the underside of each seat to support the seat from the floor. The seat columns can be pivoted to a vertical position whereat they hold the seat in a horizontal erected mode. The seat columns can also be pivoted against the undersides of the seats, which allows the seats to swing by gravity to a vertical orientation, whereat they are generally coplanar with their supporting posts. When the posts are folded to their collapsed mode, the seats fold with the posts to lie against the floor.

When the portable collapsible shelter is in its erected mode, the three floor sections are horizontal and coplanar, the four posts are vertical, and the side bars, braces, and seats are horizontal. The locking rods assure that the three floor sections remain stationary relative to each other. The slide locks associated with the posts and the braces assure that those components remain in place as the rigid frame.

The protective cover is preferably made from a flexible waterproof material such as canvas. The material is cut and sewn to fit over the frame. The cover thus cooperates with the frame and the floor to provide a shelter space defined by a roof, ceiling, and four walls. Suitable openings for a door and windows can be cut and sewn into the cover-material. The skis under the floor sections enable the erected portable collapsible shelter to be pulled with ease across ice and snow.

When it is desired to collapse the portable collapsible shelter, the protective cover is removed. The seat columns are pivoted against the undersides of the seats, and the seats swing by gravity to their vertical orientation between their supporting posts. The slide locks of each post are retracted, starting with those between the lowermost tubes and the associated floor side sections. As each slide lock is retracted, the associated tubes are pivoted such that they fold on top of each other. When the posts are fully collapsed, their tubes are oriented horizontally in respective stacks that lie in two parallel planes perpendicular to the floor folding axes, and the seats lie on the floor. In that condition, the braces remain extended horizontally between and on top of the stacks of the associated pairs of collapsed posts.

The next step in the collapsing process is to retract the slide locks of the two braces and the floor locking rods. The two floor side sections are rotated upwardly so as to be generally vertical. Consequently, the folded tubes of the posts become oriented to lie vertically along side each other. Simultaneously, the tubes of the braces pivot about their hinges to fold and lie vertically oriented along side each other and between the stacks of the associated pairs of collapsed posts. A strap is connected between the two floor side sections to hold them in their upright positions. The portable collapsible shelter is then a compact package that is easy to transport and requires minimum storage space.

When it is desired to re-erect the portable collapsible shelter, the strap holding the two floor side sections upright is removed. The floor side sections are rotated to be coplanar with the floor middle section. That action automatically causes the braces to unfold and extend horizontally over the two associated stacks of collapsed posts. Then the floor locking rods and the brace slide locks are extended to prevent rotation of the floor side sections and of the brace tubes. The two braces are lifted away from the floor, which causes the post tubes to unfold. The post slide locks are extended one at a time starting with the uppermost slide locks. The last slide locks to be extended are those between the lowermost tubes of the respective posts and the associated floor side sections. The seats are swung to their horizontal erected mode, and the seat columns are pivoted vertically under the seats to support them from the floor. With the frame thus erected, the protective cover is placed over it, and the portable collapsible shelter is again ready to use.

The method and apparatus of the invention, using collapsible posts, braces, and floor sections, thus provide a shelter that is of ample size when erected and that is easily transported and stored when collapsed. Collapsing and erecting of the portable collapsible shelter is quickly achieved by selectively extending or retracting multiple slide locks and locking rods to either rigidly interconnect associated members to each other or to enable the members to pivot relative to each other.

Other advantages, benefits, and features of the invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

GENERAL

Figure 1:
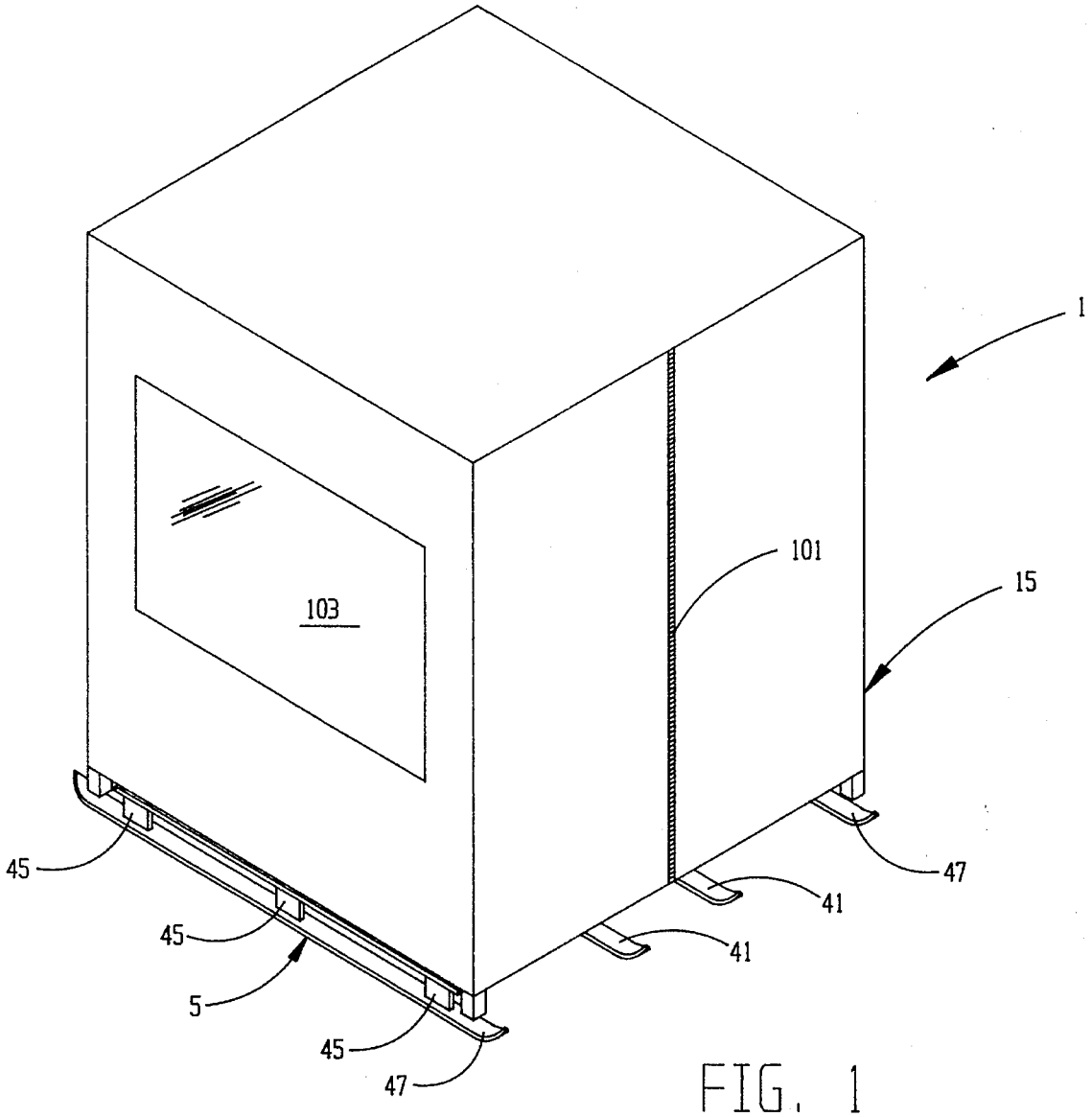
FIG. 1 is a partial perspective view of the portable collapsible shelter of the present invention.
Figure 17:
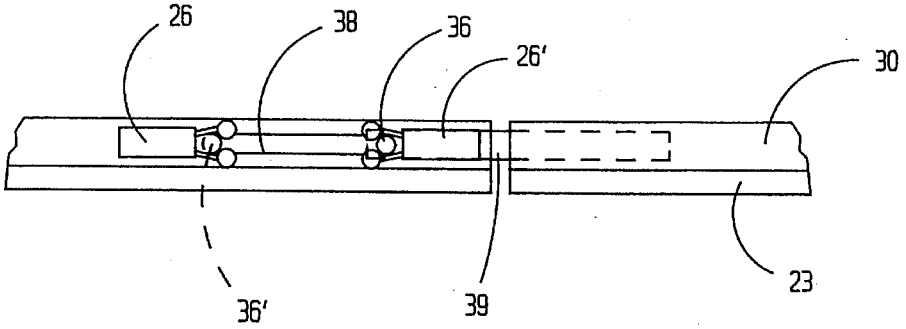
FIG. 17 is a view taken along line 17—17 of FIG. 6.

Referring to FIG. 1, a portable collapsible shelter 1 is illustrated that includes the present invention. The portable collapsible shelter 1 is particularly useful for providing shelter to ice fishermen, but it will be understood that the invention is not limited to winter use.

Figure 2:
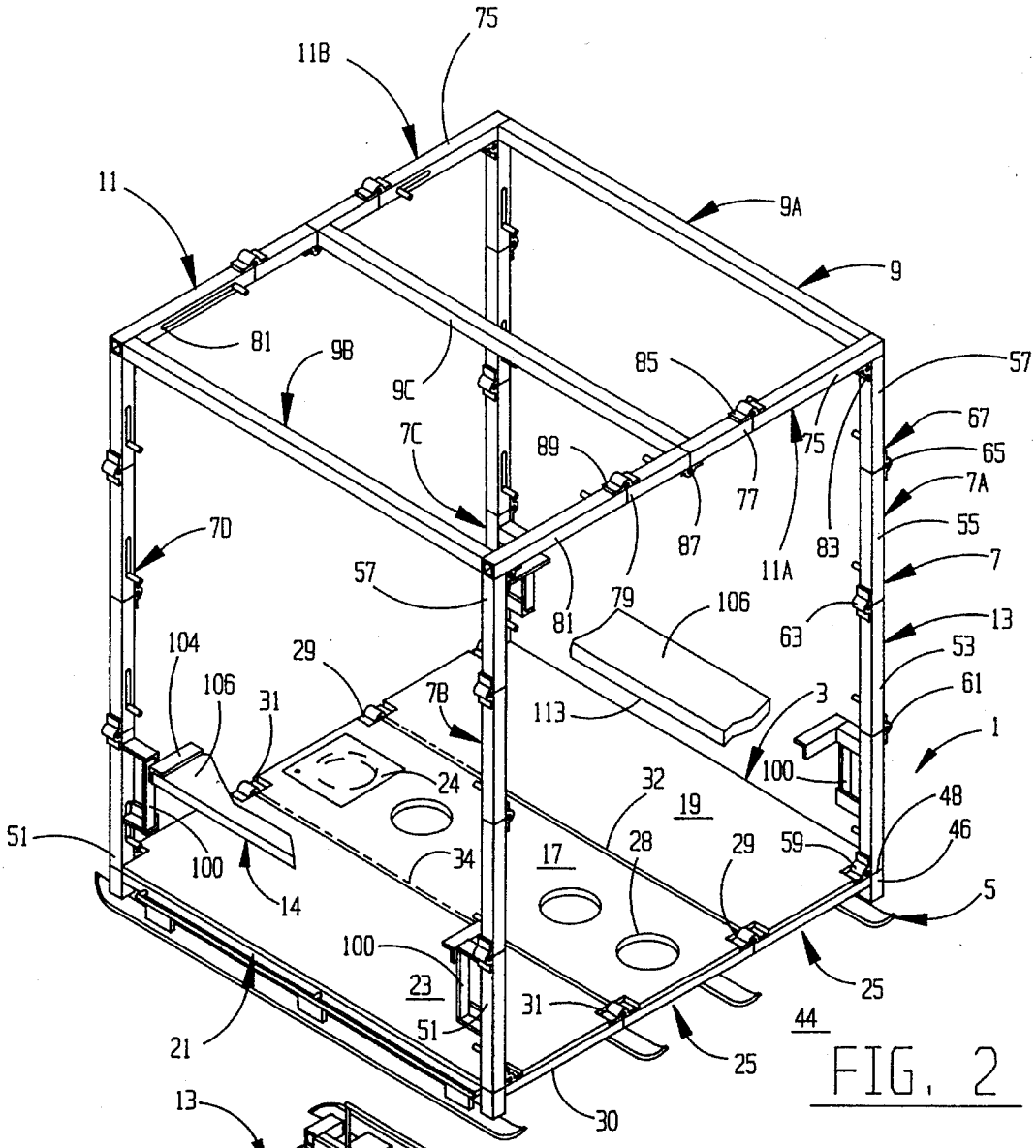
FIG. 2 is a perspective view of the floor and frame of the invention shown in the erected mode.

Looking also at FIG. 2, the portable collapsible shelter 1 is comprised of a floor 3, a frame 13, and a protective cover 15. Feet 5 support the floor 3 off the ground 44. The frame 13 is comprised of corner posts 7, rigid bars 9, braces 11, and seats 14. The frame holds the protective cover 15 in place over the floor 3 so as to make a small room with four sides, a ceiling, a floor, and built-in seats.

In FIGS. 1 and 2, the portable collapsible shelter 1 is shown in an erected mode. When in the erected mode, the floor 3 lies in a single horizontal plane, the corner posts 7 are vertical, and the bars 9, braces 11, and seats 14 are horizontal. The frame 13 is thus able to hold the protective cover 15, not shown in FIG. 2, in place.

Figure 3:
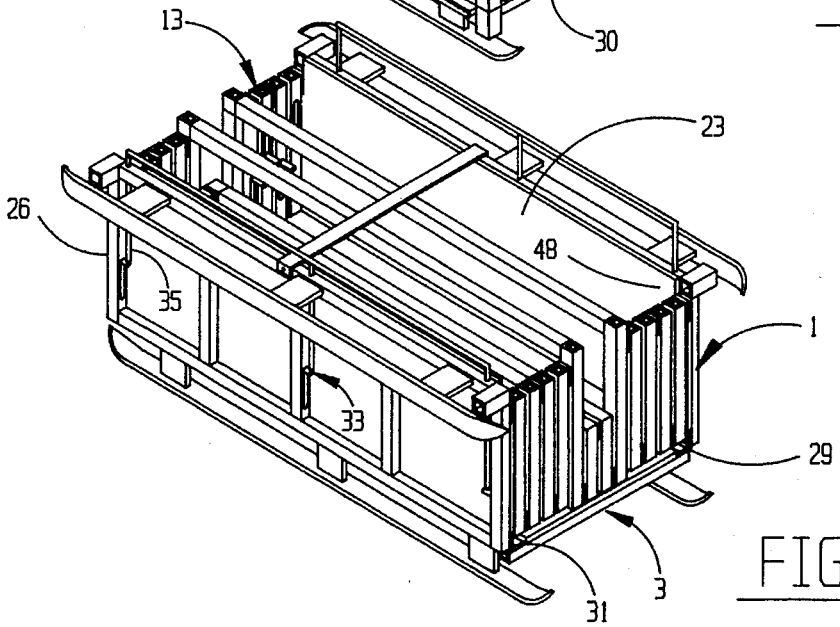
FIG. 3 is a perspective view of the floor and frame of the invention shown in the collapsed mode.

In FIG. 3, the floor 3 and frame 13 are shown in a collapsed mode. When in the collapsed mode, the protective cover 15, not shown in FIG. 3, is removed from the frame 13. The floor 3, corner posts 7, braces 11, and seats 14 fold together to occupy a small volume. The collapsed shelter is thus easy to transport and store.

FLOOR

With particular attention to FIGS. 2, 4–7, and 17, the floor 3 of the portable collapsible shelter 1 is comprised of three sections: a middle section 17, a first side section 19, and a second side section 21. The sections 17, 19, and 21 have respective flat floor boards 23 fastened to floor frameworks 25. The floor boards 23 are preferably pieces of plywood. Each floor framework 25 is composed of two longitudinally extending square tubes 27A and 27B, and three or more transverse square tubes 30. The tubes 27A, 27B and 30 may be made of steel. However, to minimize weight, I prefer that those tubes be made from aluminum. A suitable length for the floor sections is approximately 67 inches. The side sections are preferably approximately 24 inches wide and the middle section is approximately 20 inches wide. Holes of any desired size and shape, typically represented at reference numerals 28, are cut in one or more of the floor boards. The holes 28 can be removably covered with flat plates 24 that are pivotably screwed to the floor boards.

The floor middle section 17 is rotatably joined along its opposite edges to the two floor side sections 19 and 21 by two or more hinges 29 and 31. The hinges 29 and 31 enable the floor side sections 19, 21 to rotate about respective horizontal folding axes 32, 34 relative to the floor middle section. The hinges 29 and 31 thus enable the floor to be selectively placed in an erected mode as shown in FIGS. 2 and 4–6. When in the erected mode, the floor sections are all horizontal and coplanar. The hinges also enable the floor to be placed in a collapsed mode wherein the two floor side sections are vertically upright, as will be explained in detail hereinafter.

To keep the floor 3 in the erected mode, at least one and preferably three locking rods 33 are used between each floor side section 19, 21 and the middle section 17. Each locking rod 33 includes a long rod 35 that passes through the floor framework longitudinal tube 27A proximate an associated transverse tube 30. Pins 36 connect to the inside ends of the rods 35. Each pin 36 passes through an elongated slot 38 in the associated transverse tube. The pin is joined to a plunger 39 inside the transverse tube. The transverse tubes 30 of the middle and end floor sections are aligned such that the plungers 39 are free to slide within them. The outside ends of the three long rods 35 are joined to a longitudinally extending bar 42. By selectively pulling and pushing the bar 42 in the directions of arrows 37 in FIG. 4, the plungers 39 are extended into or retracted from the transverse tube 30 of the floor framework 25 of the middle floor section 17. To hold the locking rods 33 in the retracted position, catches 26 are mounted to the transverse tubes 30 adjacent each slot 38. The catches 26 receive and hold the associated pins 36, as shown by phantom line 36' in FIG. 17, when the plungers 39 are retracted from the floor middle section. Similar catches 26' are used to hold the pins when the plungers are in the extended position.

Figure 6:
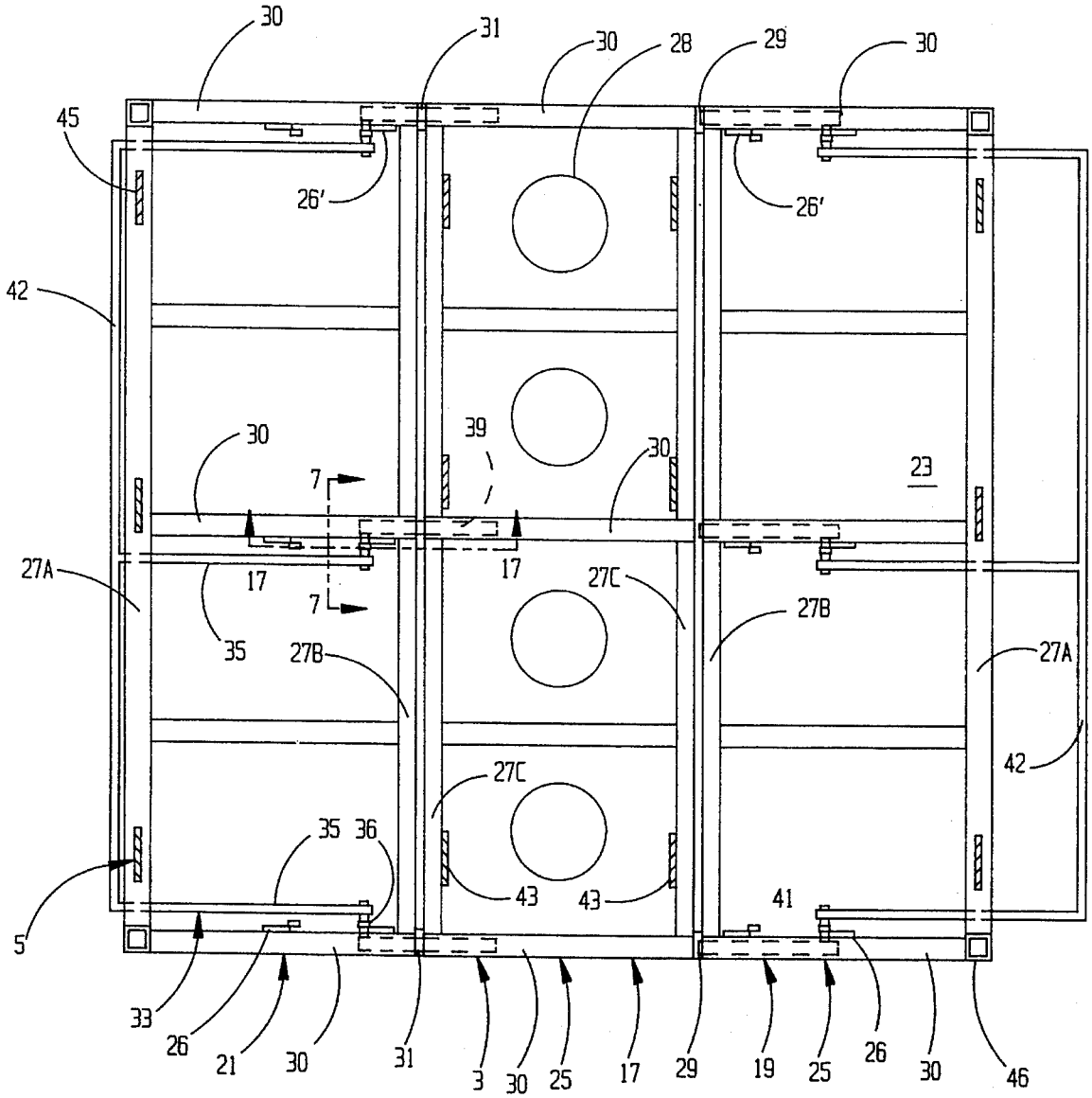
FIG. 6 is a cross sectional view taken along line 6—6 of FIG. 4.
Figure 7:
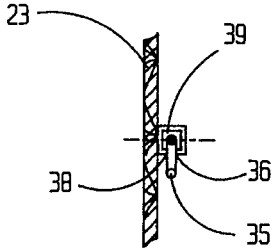
FIG. 7 is a cross sectional view taken along line 7—7 of FIG. 6.

In FIG. 6, the locking rods 33 between the floor middle section 17 and the side section 21 are shown in an extended condition. When in the extended condition, the locking rod plungers 39 are within the transverse tubes 30 of both floor sections. In that situation, the floor side sections 17 and 21 are not rotatable with respect to each other about the hinges 31. Also in FIG. 6, the locking rods between the floor middle section and the side section 19 are shown in the retracted condition. When in the retracted condition, the plungers are within only the transverse tubes 30 of the floor side section 19. Consequently, the side section 19 is free to rotate relative to the middle section by means of the hinges 29.

There is a corner tube 46 at the outside corners of each floor side section 19 and 21. The corner tubes 46 are vertically oriented. The corner tubes are welded to the picture frames 25 of the floor side sections.

FEET

To support the floor 3 off the ground 44, the portable collapsible shelter 1 includes the feet 5. In the construction illustrated in FIGS. 1–6, the feet comprise vertical legs and horizontal skis. Each floor side section 19 and 21 is equipped with three legs 45 welded to and depending from the longitudinal tubes 27A of the respective floor frameworks 25. The free ends of the legs 45 are attached to a long ski 47. The skis 47 extend in directions parallel to the folding axes 32 and 34. Similar legs 43 are welded to the longitudinal tubes 27C of the floor framework 25 of the middle floor section 17. The legs 43 are attached to skis 41. The skis 41 and 47 enable the portable collapsible shelter to be pulled with ease over snow and ice.

Figure 8:
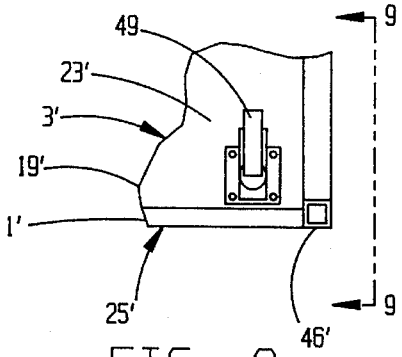
FIG. 8 is a partial bottom view of the portable collapsible shelter showing an alternative construction for the feet that support the floor off the ground.
Figure 9:
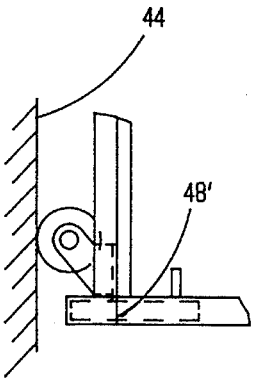
FIG. 9 is a view taken along line 9—9 of FIG. 8.

For use on ground 44 that is not snow covered, the portable collapsible shelter 1 can be equipped with roller casters rather than the legs 43, 45 and skis 41, 47. Looking at FIGS. 8 and 9, a portion of a portable collapsible shelter 1' is shown that has a floor side section 19' with a picture frame 25' and a floor board 23'. A swivelable caster 49 is attached to the floor board 23' adjacent each corner of the floor board 23', i.e., there are four casters 49 attached to each section of the floor 3'. The casters enable the portable collapsible shelter 1' to be rolled over firm but snow-free ground. The caster-equipped portable collapsible shelter 1' can thus be used not only as an ice fishing shanty on bare ice but also as a shelter for summer camping.

CORNER POSTS

Figure 4:
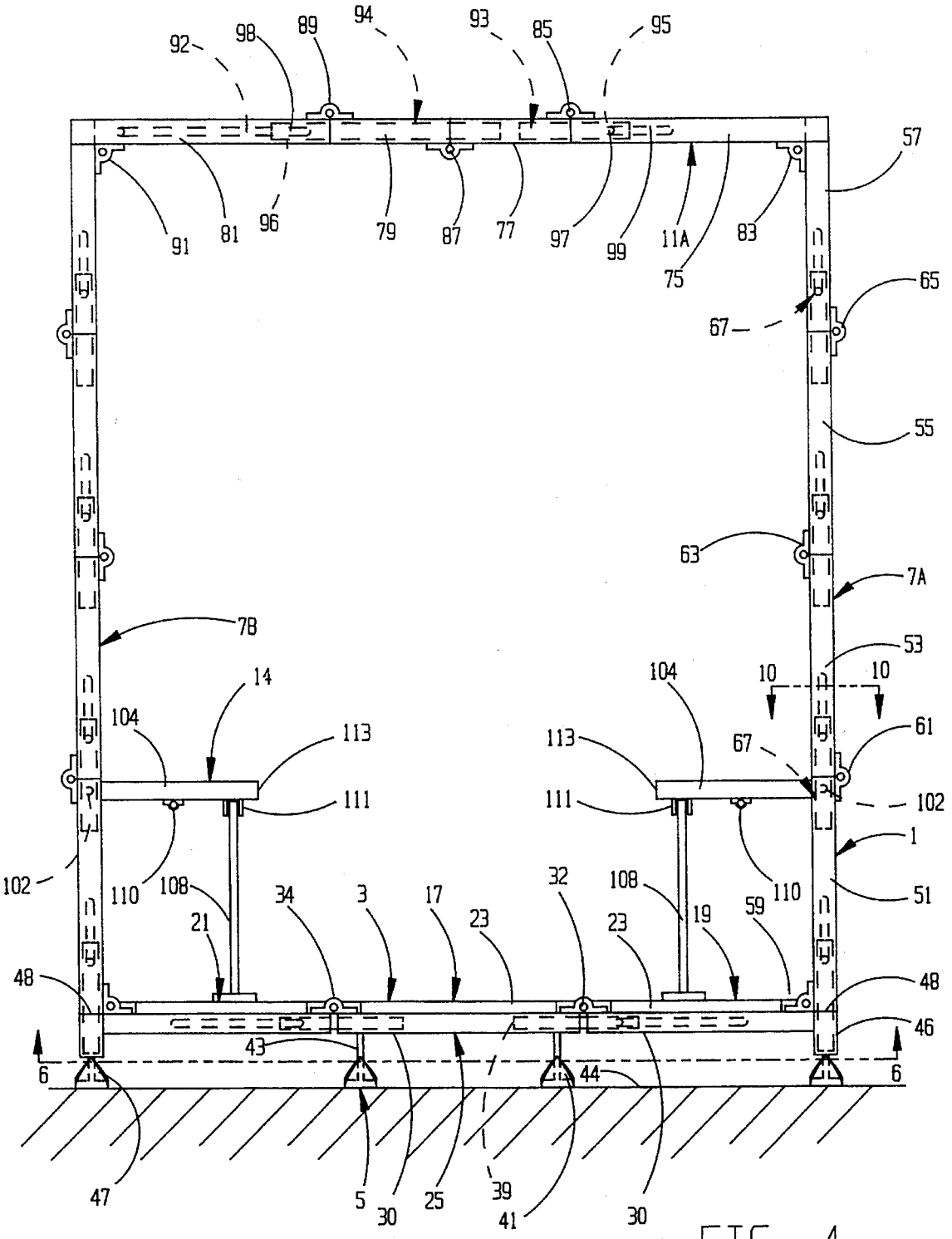
FIG. 4 is a front view of the floor and frame of the invention shown in the erected mode.
Figure 5:
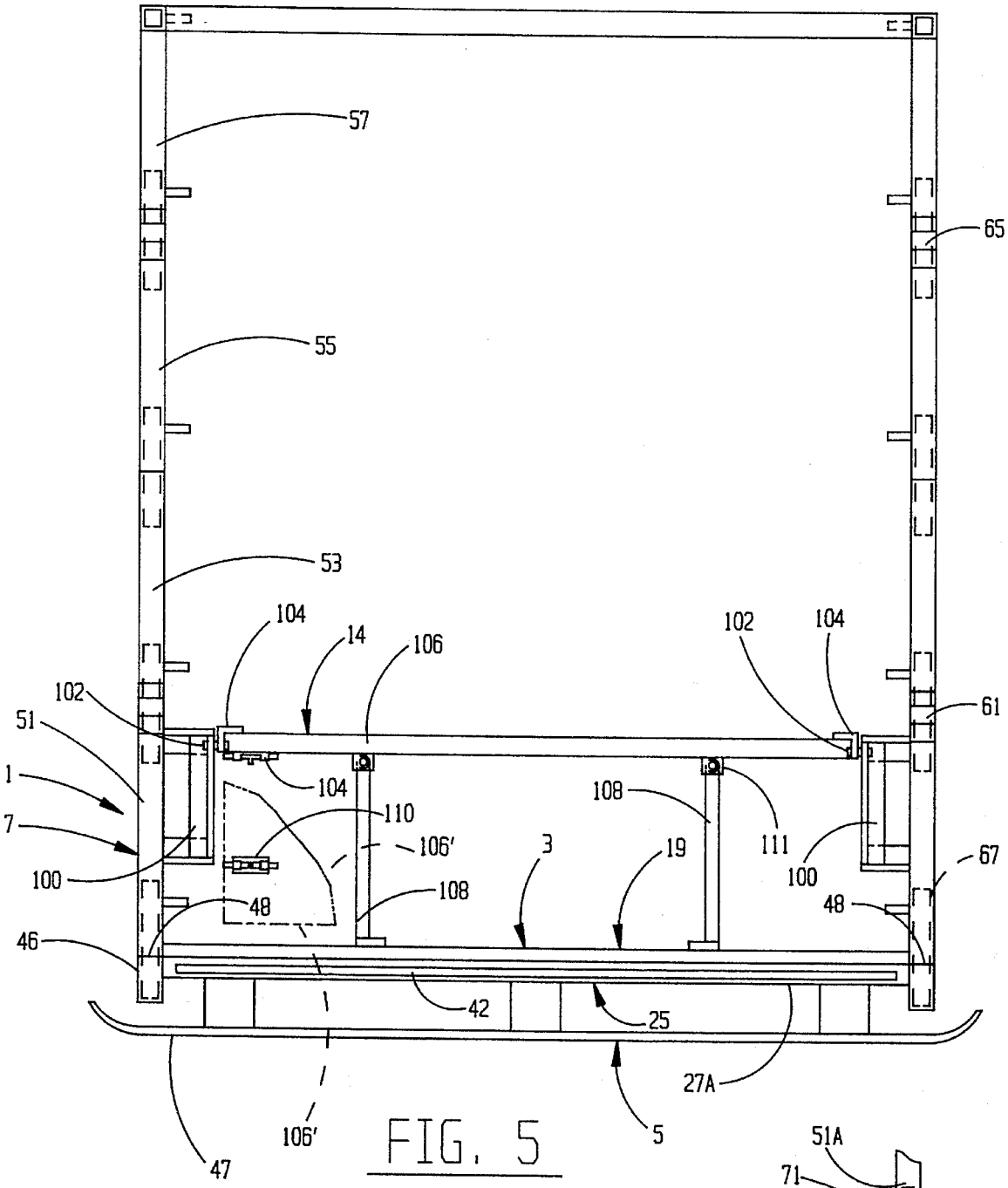
FIG. 5 is a side view of the floor and frame of the invention shown in the erected mode.

At least two pairs of posts 7 are used with the portable collapsible shelter 1. In the preferred embodiment, there is a post at each of the four outside corners of the erected floor 3. That is, there are four corner posts 7A, 7B, 7C, and 7D, with the corner posts 7A and 7B comprising one pair, and corner posts 7C and 7D comprising another pair. FIGS. 2, 4, and 5 show the corner posts in the erected mode. In the erected mode, each of the corner posts is vertically over and rests on the top surface 48 of an associated corner tube 46 of the floor side sections 19 and 21.

Each corner post 7A–7D is preferably comprised of four post tubes 51, 53, 55, and 57, all being of equal length. Each post tube 51, 53, 55, and 57 has respective upper and lower ends. The lower end of the lowermost post tube 51 is pivotally connected by a hinge 59 to the floor framework 25 of the floor side section 19. The hinge 59 enables the post tube 51 to pivot relative to the floor in a plane perpendicular to the floor folding axes 32, 34. The upper end of the post tube 51 is pivotally connected to the lower end of the post tube 53 by a hinge 61. Similarly, the post tubes 53 and 55 are connected by a hinge 63, and the post tubes 55 and 57 are connected by a hinge 65. The hinges 61, 63, and 65 permit relative pivoting of the associated post tubes in the plane perpendicular to the axes 32, 34.

Figure 10:
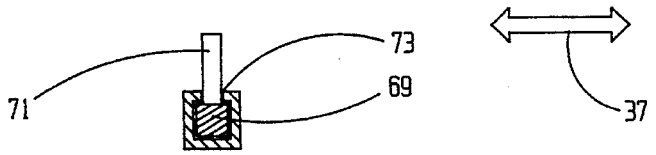
FIG. 10 is a cross sectional view on an enlarged scale taken along line 10—10 of FIG. 4.

To maintain the corner posts 7A–7D in the erected mode, there is a slide lock 67 associated with each joint between the various post tubes 51, 53, 55, and 57. There is also a slide lock 67 associated with the joint between the post tube 51 and the floor corner tube 46. Each slide lock includes a shaft 69 and a pin 71 attached to the shaft. Also see FIG. 10. The shaft 69 is free to slide within the interior of the associated post tubes. The pin 71 is free to slide within a slot 73 within one of the two posts tubes associated with each joint. The shaft 69, pin 71, and slot 73 are designed such that when the pin is at the lower end of its slot, the shaft is within both adjacent post tubes, as is shown, for example, in FIG. 4. In that situation, the slide lock is said to be extended, and the two affected tubes cannot pivot relative to each other by means of the corresponding hinge. When all the slide locks are extended, the entire corner post 7 is in its erected mode.

BRACES

Connecting the upper ends of the uppermost post tubes 57 of the corner posts 7A and 7B is a brace 11A. A similar brace 11B connects the upper ends of the uppermost post tubes 57 of the corner posts 7C and 7D. Each brace 11A, 11B is preferably comprised of four brace tubes 75, 77, 79, and 81. The brace tubes 75 are pivotally connected to the upper ends of the associated corner post tubes 57 by hinges 83. The brace tubes 75 and 77 are pivotally connected by a hinge 85, the brace tubes 77 and 79 by a hinge 87, and the brace tubes 79 and 81 by a hinge 89. The upper end of the post tube 57 of the corner post 7B is pivotally connected to the brace tube 81 by a hinge 91. The hinges 83, 85, 87, 89, and 91 enable pivoting of the associated brace tubes within a plane perpendicular to the floor folding axes 32, 34. The brace 11B is constructed in the same way as the brace 11A.

Each brace 11A, 11B further includes a short slide lock 93 and a long slide lock 94. The slide locks 93, 94 are substantially similar to the slide locks 67 described previously in conjunction with the corner posts 7. The short brace slide lock 93 has a shaft 95 with a pin 97 that protrudes through a slot 99 in the brace tube 75. The long slide lock 94 has a long shaft 96 with a pin 98 that protrudes through a long slot 92 in the brace tube 81. In FIGS. 2 and 4, the slide locks 93, 94 are shown in their respective extended conditions such that they prevent pivoting of the brace tubes 75, 77, 79, and 81 relative to each other, and also relative to the corner posts 7. When it is in the extended position, the shaft 96 of the slide lock 94 extends all the way from the brace tube 81 through the brace tube 79 and into the brace tube 77. Consequently, the braces 11A, 11B are in the erected mode when the slide locks 93 and 94 are extended.

BARS

As best shown in FIGS. 2 and 5, the bars 9 comprise a first bar 9A that extends between the corner posts 7A and 7C. One end of the first bar 9A is rigidly fastened to the brace tube 75 of the brace 11A. The other end of the first bar 9A is rigidly fastened to the brace tube 75 of the brace 11B.

A second bar 9B extends between the corner posts 7B and 7D. One end of the second bar 9B is rigidly fastened to the brace tube 81 of the brace 11A. The other end of the second bar 9B is rigidly fastened to the brace tube 81 of the brace 11B.

A third bar 9C is rigidly fastened at one end thereof to the brace tube 77 of the brace 11A. The second end of the third bar 9C is rigidly fastened to the brace tube 77 of the brace 11B.

SEATS

A first seat 14 is supported between the corner posts 7A and 7C, and another seat is supported between the corner posts 7B and 7D. Each seat is supported between the lowermost post tubes 51 of the associated corner posts. For that purpose, each lowermost corner post tube is provided with a spacer beam 100. Swingably supported to each spacer beam 100 by associated pins 102 is an angle 104 or similar member. Fastened to the angles 104 associated with the corner posts 7A and 7C is a first bench 106. A similar bench 106 is fastened to the angles 104 associated with the corner posts 7B and 7D. There are deadbolts 110 screwed to the undersides of the benches 106.

Pivotally mounted by a hinge 111 to the underside of each bench 106 is at least one and preferably two or more columns 108. Each column 108 can be pivoted about its hinge 111 to a vertical position whereat it cooperates with the pins 102 to support the associated bench at a horizontal erected mode.

COVER

The cover 15 (FIG. 1) can be made of any suitable material. It also can have any desired pattern and size openings. I prefer that the cover be made of a light, flexible, and waterproof canvas material. The cover material is cut and sewn to fit neatly over the erected frame 13. I have found that two entrances in the form of zippered openings 101 work very well. In addition, two windows 103 made of clear flexible plastic material and sewn to the canvas are very desirable.

ERECTED MODE

As described thus far, the portable collapsible shelter 1 is in its erected mode. The floor sections 17, 19, and 21 are horizontal and coplanar, being kept that way by the locking rods 33. The corner posts 7 of the frame 13 are vertical and are maintained that way by the slide locks 67. The braces 11 are maintained rigidly horizontal by the slide locks 93 and 94. The benches 106 are supported from the floor 3 by the columns 108 and from the corner posts by the pins 102 such that the benches are horizontal.

The cover 15 can then be placed over the frame 13. With the cover in place, the portable collapsible shelter 1 is ready to provide a cozy shanty for several fishermen. The windows 103 are low enough for the fishermen to see out of them while seated on the benches 106. The fishermen can thus fish in seated comfort through the holes 28 in the floor boards 23.

COLLAPSED MODE

When it is desired to collapse the portable collapsible shelter 1, the cover 15 is pulled off the frame 13. The light and flexible material of the cover makes it easy to fold and store, and it can be conveniently stored inside the collapsed shelter.

The exposed frame 13 is collapsed by first collapsing the seats 14. The columns 108 are pivoted about their respective hinges 111 against the undersides of the benches 106. The benches are swung about the pins 102 to vertical attitudes as indicated by the phantom lines 106' in FIG. 5. The benches then lie in the same general planes as the posts 7A, 7C, and 7B, 7D. The deadbolts 110 are operated to bear against the spacer beams 100 when the benches are in their vertical planes. The deadbolts function to keep the benches in the same planes as the posts 7A, 7C and 7B, 7D during the collapsing process.

Figure 11:
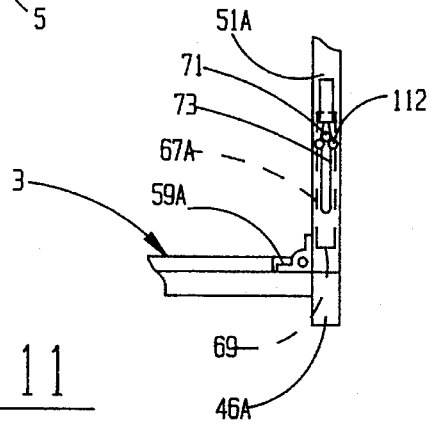
FIG. 11 is a view of a typical slide lock between a corner post tube and a floor tube shown in the retracted condition.

Next, the corner posts 7A–7D are collapsed. For that purpose, each of the four slide locks 67 between the lowermost post tubes 51 and the corner tubes 46 of the floor 3 is retracted. Retraction of the slide locks is achieved by manually lifting the pins 71 such that the associated shafts 69 lie entirely within the lowermost post tubes. As an example, FIG. 11 shows a slide lock 67A between the post tube 51A of the corner post 7A and the floor tube 46A as being in the retracted condition. When the slide lock 67A is in its retracted condition, the post tube 51A can pivot relative to the floor by means of the hinge 59A. The same is true for all other corner posts.

To keep the slide locks 67 in the retracted condition, a catch 112 is mounted to the corner post 51A at the upper end of the slot 73. The catch 112 engages the pin 71 when the pin is in the retracted condition, thereby preventing the shaft 69 from falling into the adjacent lower tube 46 during the collapsing process. Although for clarity they are not shown in the drawings, there is a catch 112 for each of the slide locks 67 of the four corner posts 7A, 7B, 7C, and 7D.

Figure 13:
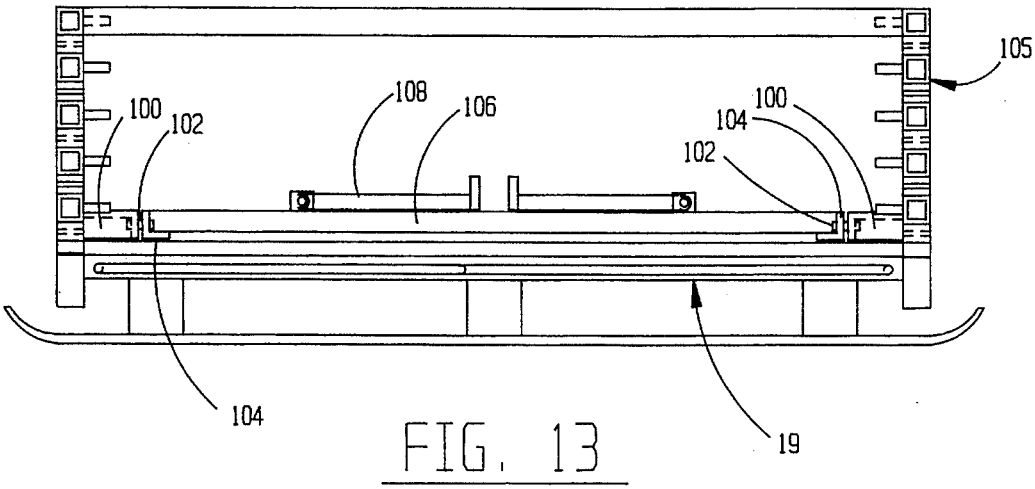
FIG. 13 is a side view of the floor and frame of the present invention shown in a partially collapsed mode.

The slide locks 67 associated with the other hinges 61, 63, and 65 of the four corner posts 7A–7D are also retracted. The result is that all of the individual post tubes 51, 53, 55, and 57 pivot about the hinges 59, 61, 63, and 65 to fold accordion style into four vertical stacks 105 that rest on the floor side sections 19 and 21, FIGS. 12 and 13. The individual post tubes 51, 53, 55, and 57 are oriented generally horizontally. The stacks of post tubes of the corner posts 7A and 7B lie in the same plane, and the stacks of post tubes of the corner posts 7C and 7D both lie in a different plane. The planes of the stacks are perpendicular to the floor folding axes 32, 34. For clarity, the individual post tubes in each stack 105 are shown parallel to and spaced from each other, but it will be appreciated that the post tubes are actually in contact with each other, with each post tube resting on the adjacent lower post tube and with the lowermost post tube 51 resting on the floor 3. Simultaneously, the benches 106 swing with the lowermost post tubes 51 to lie horizontally on top of the floor side sections. For clarity, the benches 106 are shown horizontal and spaced from the floor in FIGS. 12 and 13. In actuality, the benches lie at a slight angle to the horizontal and are supported on their free ends 113 by the floor sections 19 and 21 as well as by the pins 102.

Figure 12:
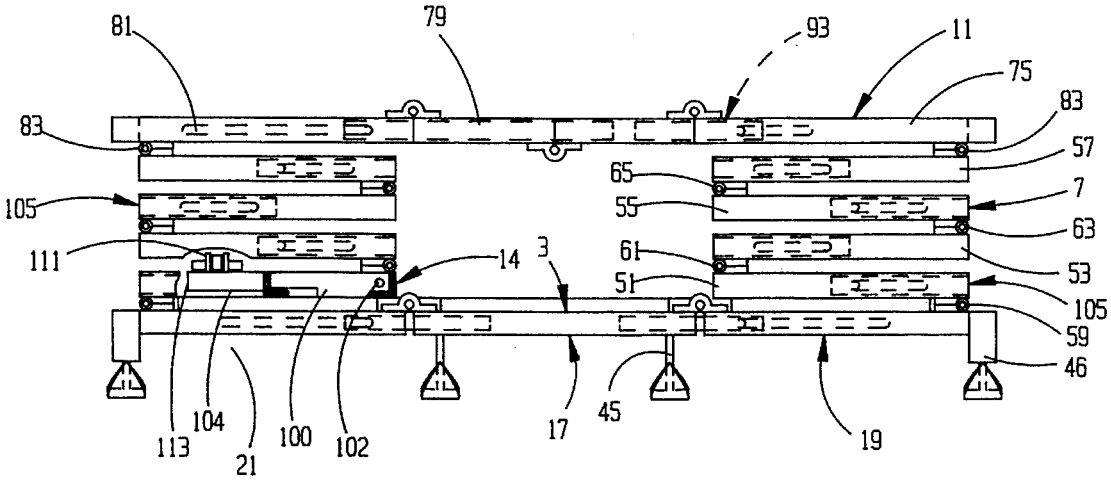
FIG. 12 is a broken front view of the floor and frame of the invention shown in a partially collapsed mode.

It will be noted in FIG. 12 that the braces 11 do not collapse with the corner posts 7. Rather, the braces remain in their erected mode even though the corner posts are collapsed. The hinges 83 enable the uppermost corner post tubes 57 to pivot with respect to the associated brace tubes 75 and 81. Consequently, each brace initially remains extended horizontally on top of the two associated stacks 105 of folded corner posts.

Figure 14:
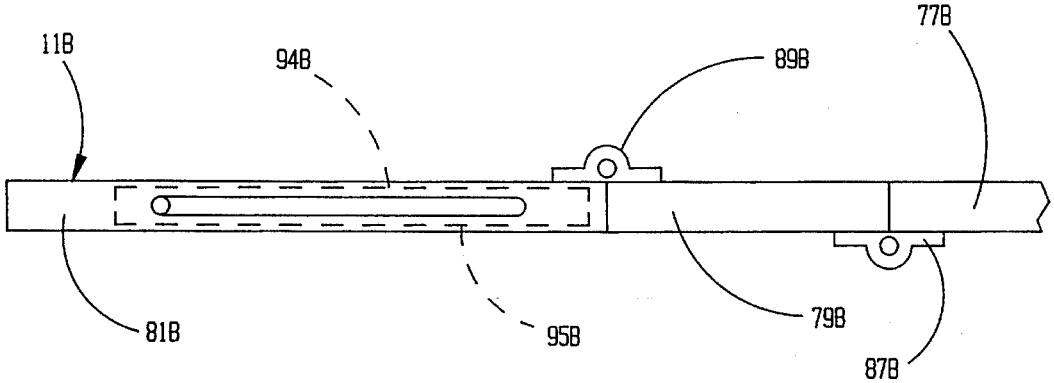
FIG. 14 is a view of a typical slide lock of a brace showing the slide lock in the retracted condition.

To collapse the braces 11, their slide locks 93 and 94 are operated to their respective retracted positions. FIG. 14 shows a typical brace 11B with a slide lock 94B between brace tubes 77B, 79B and 81B being in the retracted condition. In that condition, the shaft 95B lies entirely within the brace tube 81B. Accordingly, the brace tubes 77B, 81B and 79B are capable of pivoting relative to each other by means of the hinges 87B and 89B.

Figure 16:
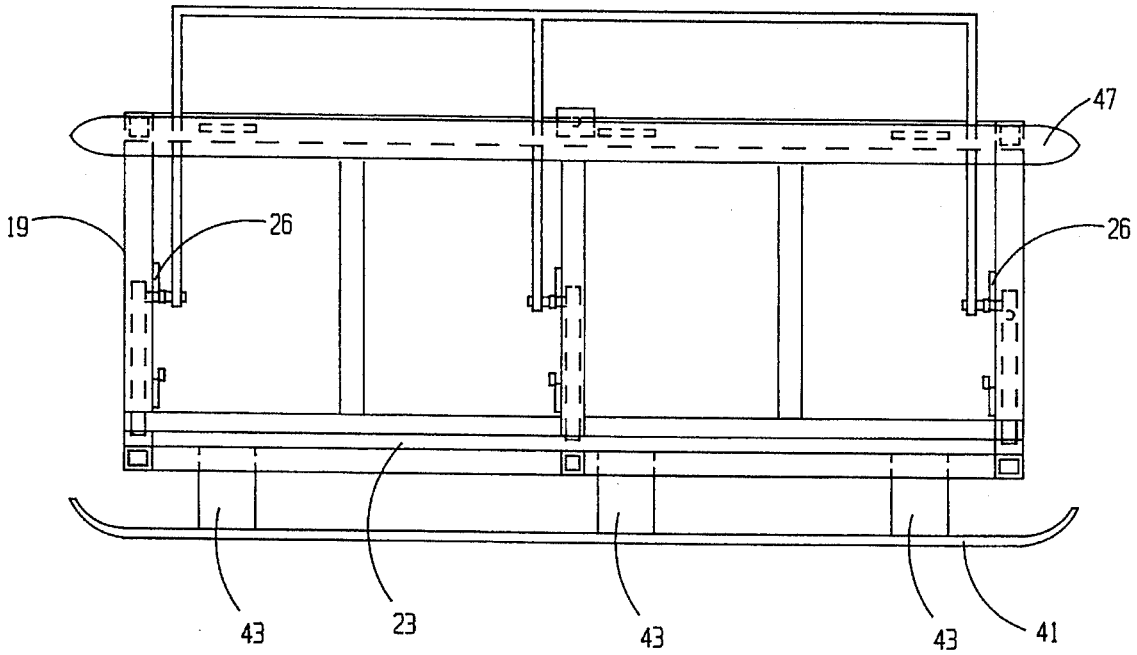
FIG. 16 is a side view of the floor and frame of the portable collapsible shelter shown in the collapsed mode.
Figure 15:
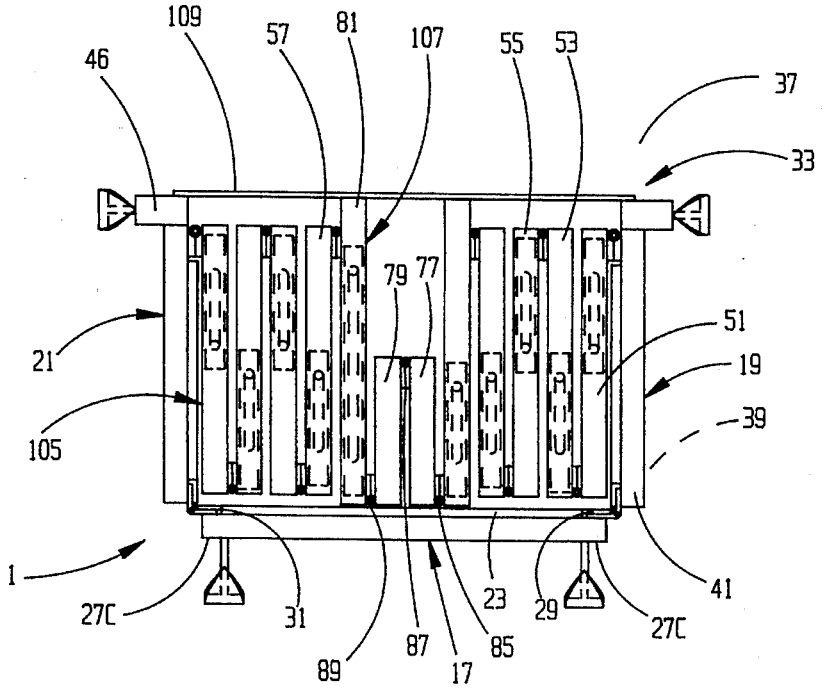
FIG. 15 is a front view of the floor and frame of the portable collapsible shelter shown in the collapsed mode.

When all the slide locks 93 and 94 of the braces 11 are in their respective retracted conditions, the final step in the collapsing process of the portable collapsible shelter 1 can be performed. That step is to rotate the floor side sections 19 and 21 to respective upright positions relative to the floor middle section 17, FIGS. 15 and 16. That is accomplished by first pulling the long bars 42 of the locking rods 33 outwardly and away from the floor middle section 17. That action causes the locking rod plungers 39 to lie entirely within the transverse tubes 30 of the floor side sections (FIG. 6). The floor side sections can then be rotated about the folding axes 32 and 34 until the floor side sections are generally vertically upright. Simultaneously, the brace tubes 75, 77, 79, and 81 pivot about the hinges 85, 87, and 89 to fold into a stack 107 with the brace tubes being oriented vertically. The stacks 107 of the brace tubes lie between the two stacks 105 of the associated post tubes 51, 53, 55, and 57. The individual post tubes and the benches 106 of the seats 14 become vertically oriented when the floor side sections are rotated upright. To hold the two floor side sections upright, one or more straps 109 are secured at their opposite ends to the floor side sections.

When in the collapsed mode, the collapsible portable shelter 1 occupies a volume that is only a fraction of its volume when it is in the erected mode. Consequently, the collapsed shelter can be stored in a space that is much smaller then is necessary for a full-sized shelter. Further, the collapsed shelter is much easier to handle and transport than a full-sized shelter.

When it is desired to again use the portable collapsible shelter 1, it is removed from its storage space and transported to the selected site. The strap 109 is removed. The side sections 19 and 21 of the floor 3 are rotated to their erected mode, i.e., parallel to the floor middle section 17. The bars 42 are pushed toward the floor middle section 17, thereby maintaining the floor sections rigidly coplanar, FIG. 12.

The slide locks 93 and 94 of the braces 11 are operated to their respective extended conditions, thereby rigidly locking the brace tubes 75, 77, 79, and 81 into the rigid braces. The bars 9 are lifted together away from the floor 3, thereby raising the braces and unfolding the post tubes 51, 53, 55, and 57 of the corner posts 7. The seats 14 rise off the floor 3 together with the lowermost post tubes such that the benches 106 hang vertically between the associated corner posts 7A, 7C and 7B, 7D. The slide locks 67 of the corner posts are operated to their respective extended conditions, starting with the uppermost slide locks between the post tubes 55 and 57 and working downwardly to the slide locks between the post tubes 51 and the floor tubes 46. When all the slide locks are properly in their extended conditions, the deadbolts 110 on the seat benches 106 are unlocked from against the spacer beams 100. The benches are swung to their horizontal attitudes and supported on the floor by the columns 108. The frame 13 is then again ready to receive the cover 15, FIG. 2.

In summary, the results and advantages of portable shelters can now be more fully realized. The portable collapsible shelter 1 of the invention provides both a large comfortable outdoor shelter as well as a compact and easy-to-store package. This desirable result comes from using the combined functions of the floor 3, corner posts 7, braces 11, and seats 14. The floor, corner posts, braces, and seats have respective components that cooperate to enable the shelter to be placed in an erected mode or in a collapsed mode. When in the erected mode, slide locks 67 on the corner posts and 93, 94 on the braces, respectively, hold those components as a rigid frame 13 that supports the flexible protective cover 15. Locking rods 33 maintain the floor in a rigid horizontal plane. To collapse the shelter, the slide locks and locking rods are operated to enable the corner posts to fold accordion style into respective stacks on the floor. Then the floor is folded in a manner that also folds the braces such that the floor, corner posts, and braces occupy a minimum of space.

It will also be recognized that in addition to the superior performance of the portable collapsible shelter 1, its construction is such that its cost of manufacture compares favorably with traditional shelters. Also, since the design and construction of the invention employ simple and rugged components, the need for maintenance is minimal.

Thus, it is apparent that there has been provided, in accordance with the invention, a portable collapsible shelter that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A portable collapsible shelter comprising:

a. a floor selectively foldable between erected and collapsed modes, wherein the floor comprises a horizontal middle section having opposite sides, and two side sections each rotatably joined along opposite sides of the middle section, the side sections being rotatable to selectively place the floor in the erected mode whereat the side sections are coplanar with the middle section and the collapsed mode whereat the side sections are vertically upright;

b. at least two pairs of corner posts, each corner post having a lowermost end pivotally connected to the floor and an uppermost end, each corner post being selectively foldable between erected and collapsed modes;

c. at least two braces, each brace having a first end pivotally connected to the uppermost end of a first corner post of a pair thereof and a second end pivotally connected to the uppermost end of the second corner post of the pair thereof, each brace being selectively foldable between erected and collapsed modes;

d. at least two elongated bars extending between the braces, each bar being rigidly fastened at one end thereof to one of the braces and at the other end thereof to the other brace, the bars cooperating with the corner posts and braces to form a frame that is selectively erectable and collapsible in response to the corner posts and the braces being in their respective erected and collapsed modes;

e. cover means for removably fitting over the frame when the frame is in the erected mode to cooperate with the floor to define an enclosed shelter; and f. at least one locking rod between each of the floor side sections and the floor middle section, the locking rods being slidable within the floor side sections between an extended condition that keeps the floor in the erected mode and a retracted condition that enables the floor to be folded to the collapsed mode.

2. A portable collapsible shelter comprising:

a. a floor selectively foldable between erected and collapsed modes, wherein the floor comprises a horizontal middle section having opposite sides, and two side sections each rotatably joined along opposite sides of the middle section, the side sections being rotatable to selectively place the floor in the erected mode whereat the side sections are coplanar with the middle section and the collapsed mode whereat the side sections are vertically upright;

b. at least two pairs of corner posts, each corner post having a lowermost end pivotally connected to the floor and an uppermost end, each corner post being selectively foldable between erected and collapsed modes, wherein each corner post comprises a plurality of post tubes including a lowermost post tube, an uppermost post tube, and at least one intermediate post tube between the uppermost and lowermost post tubes, each post tube having an upper and a lower end, the lower end of the lowermost post tube being pivotally connected to the floor, the corner posts being free of any connection to the floor external of the corner post tubes, the lower ends of the uppermost and intermediate post tubes being pivotally connected to the upper ends of respective adjacent lower post tubes, the post tubes being vertical and coaxial when the corner post is in the erected mode and being folded accordion style in a stack when the corner post is in the collapsed mode;

c. at least two braces, each brace having a first end pivotally connected to the uppermost end of a first corner post of a pair thereof and a second end pivotally connected to the uppermost end of the second corner post of the pair thereof, each brace being selectively foldable between erected and collapsed modes, the braces being free of any connections with the floor middle section;

d. at least two elongated bars extending between the braces, each bar being rigidly fastened at one end thereof to one of the braces and at the other end thereof to the other brace, the bars cooperating with the corner posts and braces to form a frame that is selectively erectable and collapsible in response to the corner posts and the braces being in their respective erected and collapsed modes; and e. cover means for removably fitting over the frame when the frame is in the erected mode to cooperate with the floor to define an enclosed shelter.

3. The portable collapsible shelter of claim 2 further comprising slide lock means associated with each corner post for selectively sliding between an extended condition to prevent pivoting of adjacent post tubes and a retracted condition to enable pivoting of adjacent post tubes.

4. The portable collapsible shelter of claim 3 wherein the slide lock means comprises:

a. a shaft slidable inside two adjacent post tubes; and b. a pin attached to the shaft and extending through a slot in one of the two adjacent post tubes, the pin being selectively pushable to a first end of the slot to extend the shaft to lie within the two adjacent post tubes and thereby prevent pivoting of the two adjacent post tubes relative to each other, and to a second end of the slot to retract the shaft to lie entirely within one of the two adjacent post tubes and thereby enable pivoting of the two adjacent post tubes relative to each other.

5. The portable collapsible shelter of claim 3 wherein the slide lock means comprises:

a. a floor tube fixed to the floor in operative association with each corner post;

b. a shaft selectively slidable inside the lowermost tube of each corner post and inside the associated floor tube; and c. a pin attached to the shaft and extending through a slot in the lowermost post tube, the pin being selectively pushable to a first end of the slot to extend the shaft to lie within the lowermost post tube and the floor tube and thereby prevent rotation of the lowermost post tube relative to the floor, and to a second end of the slot to retract the shaft to lie entirely within the lowermost post tube and thereby enable pivoting of the lowermost post tube relative to the floor.

6. The portable collapsible shelter of claim 1 wherein each brace comprises a plurality of brace tubes having respective ends and including a first end brace tube that defines the brace first end, a second end brace tube that defines the brace second end, and at least one intermediate brace tube between the first and second end brace tubes, the ends of the brace tubes being pivotally connected to the ends of respective adjacent brace tubes, the brace tubes being horizontal and colinear when the brace is in the erected mode and being folded accordion style in a stack when the brace is in the collapsed mode, and further comprising slide lock means associated with each brace for selectively operating between an extended condition to prevent pivoting of adjacent brace tubes and a retracted condition to enable pivoting of adjacent brace tubes.

7. The portable collapsible shelter of claim 1 further comprising leg means attached to the floor middle and side sections for supporting the floor off the ground when the floor is in the erected mode thereof, the leg means attached to the floor middle section being the sole support for the floor off the ground when the floor is in the collapsed mode thereof, and wherein the leg means comprises a plurality of casters attached to each of the floor middle and side sections.

8. The portable collapsible shelter of claim 2 further comprising seat means swingably supported by the lowermost post tubes of two corner posts from different pairs thereof for swinging between an erected mode whereat the seat means is in a generally horizontal attitude and a collapsed mode whereat the seat means is generally vertical and coplanar with the lowermost post tubes when the lowermost post tubes are in their erected mode.

9. Apparatus for providing temporary shelter comprising:

a. a floor having a middle section and two side sections that are rotatable relative to the middle section to enable the floor to rotate between erected and collapsed modes, wherein:

i. the floor middle section is horizontal and has opposite sides; and ii. the floor side sections are rotatably joined each to an opposite side of the middle section, the side sections being coplanar with the middle section when the floor is in the erected mode, the side sections being vertically upright when the floor is in the collapsed mode; and iii. each floor side section has at least one tube that is aligned with an associated tube on the floor middle section;

b. frame means pivotally connected to the floor side sections for folding between erected and collapsed modes;

c. cover means for covering the frame means when the frame means and the floor are in the erected modes thereof to cooperate with the floor to provide an enclosed shelter; and d. locking rod means for selectively preventing and enabling rotation of the floor side sections relative to the floor middle section, wherein the locking rod means comprises:

i. a shaft slidable inside the tube of each floor side section; and ii. a pin attached to each shaft and extending through a slot in the tube of the floor side section, the pin being selectively pushable to a first end of the slot to extend the shaft to lie within the associated tube in the floor middle section and thereby prevent rotation of the floor sections relative to each other, and to a second end of the slot to retract the shaft to lie entirely within the tube in the floor side section and thereby enable rotation of the floor side section relative to the floor middle section.

10. The apparatus of claim 9 wherein the frame means comprises:

a. post means pivotally connected solely to the floor side sections for folding between erected and collapsed modes independently of the rotation of the floor between the erected and collapsed modes thereof;

b. brace means pivotally connected solely to the post means for moving away and toward the floor with the post means in response to folding the post means to the erected and collapsed modes, respectfully, thereof and for folding between erected and collapsed modes solely in response to rotating the floor between the erected and collapsed modes, respectively, thereof; and c. bar means rigidly fixed to the brace means for moving with the brace means between the erected and collapsed modes of the post means.

11. The apparatus of claim 9 wherein the frame means comprises:

a. at least two pairs of corner posts, each pair of corner posts having a first post pivotally connected to a first floor side section and a second post pivotally connected to the second floor side section, the corner posts of each pair thereof being foldable between the erected mode whereat the posts are vertically upstanding from the associated floor side sections and the collapsed mode whereat the posts are folded into respective coplanar vertical stacks on the associated floor side sections;

b. at least two braces each having opposite ends pivotally connected to the corner posts of a pair thereof, the braces being free of any connections to the floor middle section, each brace being foldable between the erected mode whereat the brace is straight and horizontal, the braces being straight and horizontal when the corner posts are in their collapsed mode and the floor is in the erected mode, and the collapsed mode whereat the brace is folded into a vertical stack coplanar with the stacks of the pair of associated collapsed corner posts; and c. bar means extending between and rigidly fixed to the braces for providing support between the pairs of corner posts.

12. The apparatus of claim 11 wherein each corner post comprises:

a. a lowermost post tube having a lower end pivotally connected to the associated floor side section, an uppermost post tube pivotally connected to an end of an associated brace, and a plurality of intermediate post tubes between the lowermost and uppermost post tubes;

b. hinge means for enabling the uppermost, intermediate, and lowermost post tubes to pivot relative to each other;

c. first post locking means for selectively preventing the lowermost, intermediate, and uppermost post tubes from pivoting relative to each other, wherein the first post locking means comprises a plurality of first slide locks each in operative association with respective adjacent post tubes of the corner posts, each first slide lock comprising:

i. a shaft slidable inside the respective adjacent post tubes; and ii. a pin protruding through a slot in a selected one of the respective adjacent post tubes and being attached to the shaft for sliding therewith, the shaft being within both adjacent post tubes when the pin is at one end of the slot to thereby prevent pivoting of the post tubes relative to each other, the shaft being within only one of the adjacent post tubes when the pin is at the other end of the slot to thereby enable the adjacent the post tubes to pivot relative to each other; and d. second post locking means for selectively preventing the lowermost post tube from pivoting relative to the associated floor side section, wherein the second post locking means comprises:

i. a floor tube fixed to the floor side section;

ii. a shaft slidable inside the floor tube and the lowermost post tube of the corner post; and iii. a pin protruding through a slot of the corner post lowermost tube and attached to the shaft for sliding therewith, the shaft being within both the corner post lowermost tube and the floor tube when the pin is at one end of the slot to thereby prevent pivoting of the corner post lowermost tube relative to the floor section, the shaft being only within the corner post lowermost tube when the pin is at the other end of the slot to thereby enable the corner post lowermost tube to pivot relative to the floor tube.

13. The apparatus of claim 11 wherein each brace comprises:

a. first and second brace tubes having respective ends that are pivotally connected to an associated corner post and a plurality of intermediate brace tubes between the first and second end brace tubes, the intermediate brace tubes being free of any support from the floor middle section;

b. hinge means for enabling the end and intermediate brace tubes to pivot relative to each other; and c. brace locking means for selectively preventing the brace end and intermediate tubes from pivoting relative to each other.

14. The apparatus of claim 10 further comprising:

a. first slide lock means for selectively enabling and preventing folding of the post means between the erected and collapsed modes thereof; and b. second slide lock means for selectively enabling and preventing folding of the brace means between the erected and collapsed modes thereof.

15. The apparatus of claim 12 further comprising:

a. a bench swingably supported by the lowermost post tubes of two corner posts from different pairs thereof; and b. column means for selectively supporting the bench from the floor in an erected mode whereat the bench is generally horizontal and for enabling the bench to swing to a collapsed mode whereat the bench is in a vertical attitude coplanar with the lowermost post tubes that support the bench when the corner posts are in the erected mode thereof.

16. The apparatus of claim 12 wherein each first slide lock comprises catch means associated with the slide lock pin for holding the slide lock in place when the pin is at the other end of the slot to enable adjacent post tubes to pivot relative to each other.

17. A method of collapsing a shelter comprising the steps of:

a. providing a floor having a horizontal middle section and two side sections rotatably joined to the middle section;

b. pivotally connecting at least two pairs of corner posts to the floor side sections;

c. pivotally connecting a brace between the corner posts of each pair thereof;

d. folding each pair of corner posts into respective coplanar stacks resting on the associated floor side section;

e. rotating the two floor side sections into vertical upright positions and simultaneously folding the braces into respective stacks lying between the stacks of the associated pair of corner posts; and f. retracting slide locks operatively associated with the corner posts and with the braces prior to folding the corner posts and the braces into their respective stacks.

18. The method of claim 17 comprising the further step of retracting locking rods in operative association with the floor middle and side sections prior to rotating the floor side sections to their vertical upright positions.

* * * * *